US006246860B1

(12) United States Patent
Ohmichi

(10) Patent No.: US 6,246,860 B1
(45) Date of Patent: Jun. 12, 2001

(54) SHEET DECURLING APPARATUS

(75) Inventor: Yoshiki Ohmichi, Toyokawa (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/513,849

(22) Filed: Feb. 25, 2000

(30) Foreign Application Priority Data

Feb. 26, 1999 (JP) ..... 11-049571

(51) Int. Cl.[7] ..... B65H 29/70; G03G 15/00

(52) U.S. Cl. ..... 399/406; 271/188; 399/45; 399/389; 493/459

(58) Field of Search ..... 399/406, 391, 399/390, 389, 45, 43; 271/161, 188, 209, 242, 265.01, 266; 493/459; 162/197, 270, 271

(56) References Cited

U.S. PATENT DOCUMENTS

| | | | | |
|---|---|---|---|---|
| 4,505,695 | * | 3/1985 | Billings | 493/459 |
| 4,591,259 | * | 5/1986 | Kuo et al. | 399/406 |
| 4,977,432 | | 12/1990 | Coombs et al. | 399/404 |
| 5,123,895 | * | 6/1992 | Mandel | 493/459 |
| 5,300,012 | | 4/1994 | Kamada | 493/459 |
| 5,539,511 | | 7/1996 | Wenthe, Jr. et al. | 399/361 |
| 5,565,970 | * | 10/1996 | Suda | 399/406 |
| 5,758,251 | * | 5/1998 | Takahashi et al. | 271/188 X |
| 5,765,093 | * | 6/1998 | Funato | 399/406 |
| 5,787,331 | * | 7/1998 | Ohkuma et al. | 399/406 |

FOREIGN PATENT DOCUMENTS

| | | | |
|---|---|---|---|
| 63-225051 | * | 9/1988 | (JP) . |
| 1-167164 | | 6/1989 | (JP) . |
| 1-226653 | * | 9/1989 | (JP) . |
| 4-173655 | | 6/1992 | (JP) . |
| 7-267464 | * | 10/1995 | (JP) . |
| 9-124212 | * | 5/1997 | (JP) . |

* cited by examiner

*Primary Examiner*—Sophia S. Chen
(74) *Attorney, Agent, or Firm*—McDermott, Will & Emery

(57) ABSTRACT

In an electrophotographic image forming apparatus, curling occurs in the sheet when it passes through the thermal fixing device. The invention equips the apparatus with a decurling path having a decurling mechanism and a path without any such mechanism, as well as an alternating claw that guides the sheet to either of the paths, such that the alternating claw 9 alternates between the paths based on the settings for each sheet supply unit that supplies the sheets. The sheets from a sheet supply unit that requires decurling are guided to the decurling path and decurling is performed. On the other hand, sheets from a manual paper tray in which special types of paper, such as transparencies, are often placed are guided to the path without any decurling mechanism and no decurling is performed. Consequently, a sheet decurling apparatus that appropriately decurls the curling of plain paper only and does not perform decurling on special types of paper, such as thick paper or transparencies, may be realized without an increase in cost.

16 Claims, 21 Drawing Sheets

SHEET DECURLING APPARATUS

RELATED APPLICATIONS

The present application claims priority to Japanese Patent Application No. 11-49571 filed Feb. 26, 1999, the contents of which are hereby incorporated by reference.

BACKGROUND OF THE INVENTION

1. Field of the Invention

The present invention pertains to a sheet decurling apparatus, and more particularly to a sheet decurling apparatus that removes the curling of sheets of paper caused by the thermal fixing of the toner image onto the sheet in image forming apparatuses such as copying machines, printers and facsimile machines.

2. Description of the Related Art

Conventionally, a sheet decurling apparatus of this kind has multiple conveyance paths and a fixed conveyance path alternating means that alternates the conveyance paths from one to the other depending on the degree of curling of the sheet, such that it automatically guides sheets that are curled to a prescribed degree or more at their top edges to a decurling conveyor path and sheets that are not curled to the prescribed degree to a non-decurling conveyance path, as disclosed in U.S. Pat. No. 5,300,012, for example. Technologies in which the degree and direction of the curling are detected by sensors and the appropriate conveyance path is selected accordingly, or in which the device is equipped with a decurling mechanism capable of varying the amount of decurling to ensure appropriate decurling have also been proposed.

Other technologies also exist in which the curling is removed by creating a loop in the sheet by stopping the rollers that convey the sheet for a prescribed period of time, as disclosed in Japanese Laid-Open Publication 1-167164, or in which appropriate decurling is attempted by detecting the degree of curling by a sensor and varying the speeds of the rollers, as disclosed in Japanese Laid-Open Publication 4-173655.

However, in the method disclosed in U.S. Pat. No. 5,300,012, the selection of a conveyance path depends on the degree of curling at the top edge of the sheet, and therefore, even when a sheet that is not curled is flush with the upper guide plate, the decurling path is selected, resulting in a lack of accuracy. In addition, the direction of curling varies: some sheets curl along the direction of conveyance and some curl in the direction perpendicular to the direction of conveyance, depending on the direction of the grain of the paper. Consequently, using the method in which the degree and direction of curling are detected, it is difficult to accurately detect the degree of curling in both directions. Even if it could be done, this method would inevitably entail an increase in cost, and is therefore impractical.

Moreover, the sheet decurling device is set such that the curling of sheets of plain paper, which is used in most cases, may be appropriately removed, presenting the ancillary effect that when thick paper or transparencies pass through, the reverse effect occurs, resulting in large curling in the opposite direction.

In the technology disclosed in Japanese Laid-Open Publication 1-167164, while the amount of loop formed at the rear edge of the sheet is constant, the degree of curling that occurs through the thermal fixing process varies depending on the properties of the sheet. In addition, the degree of curling tends to increase as the number of sheets that pass through the apparatus increases in continuous printing mode, or under similar conditions. This results in the problem that the decurling effect is either insufficient if the degree of decurling is constant or excessive where the sheet curls in the opposite direction.

The technology disclosed in Japanese Laid-Open Publication 4-173655 detects the degree of curling at the top edge of the sheet by multiple transmission sensors, but the problem exists that the probability of erroneous detection can be high depending on the behavior of the sheet while it is passing through the apparatus.

SUMMARY OF THE INVENTION

The object of the present invention is to resolve the problems identified above.

Another object of the present invention is to provide a sheet decurling apparatus that does not decurl special types of paper such as thick paper and transparencies, and that decurls plain paper only without any increase in cost.

Yet another object of the present invention is to provide a sheet decurling apparatus capable of performing appropriate decurl using a simple construction by detecting the properties or parameters of the sheet and performing control so that an amount of loop specified in advance may be obtained, or by selecting a conveyance path based on the detection results.

These and other objects may be attained by a sheet decurling apparatus, comprising: a plurality of sheet supply units; a first conveyance path that has a decurling device within its length and that conveys the sheets supplied from a sheet supply unit; a second conveyance path that does not have a decurling device within its length and that conveys the sheets supplied from a sheet supply unit; and selecting means for selecting either the first or second conveyance path depending on the sheet supply unit used.

In the construction described above, prescribed types of sheet are placed in the sheet supply units, and selecting means operates a conveyance path alternating means to alternate the conveyance paths based on the setting of each sheet supply unit. Sheets supplied from a sheet supply unit that requires decurling are guided to the first conveyance path equipped with a decurling device, and sheets supplied from a sheet supply unit that does not require decurling are guided to the second conveyance path that is not equipped with a decurling device. Each sheet supply unit comprises a sheet cassette or manual sheet tray. A drive means such as a solenoid may be used for the conveyance alternating means. It is preferred that the decurling device comprises means for warping the sheet in the direction opposite the direction of the curling caused through the thermal fixing process.

The objects of the present invention are further attained by a sheet decurling apparatus, comprising: a plurality of sheet supply units; a conveyance path to convey the sheets supplied from the sheet supply units; a decurler that is located within the length of the conveyance path and that decurls the sheet; varying means for varies the degree of the curling effect exerted by the decurler; and controller that controls the varying means depending on the sheet supply unit used.

In this construction, the controller changes the degree of curling exerted by the decurler on the sheet based on the settings that are set in advance for each sheet supply unit. For vary means to vary the decurling effect, a mechanism that changes the amount of pressure exerted by the decurler using a drive means such as a cam or solenoid may be used. In addition, it is preferred that the degree of the effect by the decurler may be specified depending on the sheet supply unit used.

It is further preferred that it be specified in advance for each sheet supply unit whether or not decurling is to be performed, such that control may be performed based on that setting. For example, where sheets are supplied from a paper cassette, plain paper is used in most cases, and therefore it is more appropriate to select performance of decurling. In this case, setting should be made so that decurling will occur automatically. On the other hand, where sheets are supplied from a manual paper tray, it is highly likely that a special type of paper will be used, and it is thus safer not to perform decurling. Therefore, setting should be made so that automatic decurling will not be performed.

The objects are also attained by a sheet decurling apparatus comprising: first conveyance for conveying the sheets; second conveyance means that is located downstream from the first conveyance means; loop creating means that creates a loop in the sheet being conveyed by making the conveyance speed of the top edge of the sheet conveyed by the second conveyance means different from the speed by which it is conveyed by the first conveyance means; detector that detects the properties of the sheet; and controller that controls the creation of a loop by the loop creating means based on the results of detection by the detector.

In this construction, the creation of a loop is controlled and the degree of decurling is adjusted based on the results of the detection of the properties (parameters, etc.) of the sheet. The means to detect the properties may comprise, for example, a method in which the properties are selected from the operation panel when the operator sets the print mode. The curling caused by the thermal fixing process tends to occur less as the thickness of the sheet increases. Therefore, control should be performed such that the curve of the loop decreases or is reduced to zero as the thickness of the sheet increases.

The device may also be equipped with a counter that counts the number of sheets that are continuously conveyed in one print session, such that the loop creating means is controlled based on the output from the counter. In this construction, appropriate decurling may be performed by carrying out control such that a prescribed amount of loop may be created depending on the number of sheets passing through the apparatus despite the tendency for the degree of curling of the sheet to change gradually when the sheets are supplied on a continuous basis.

The loop creating means is located downstream from the thermal fixing unit, and the cavity that receives the loop in the sheet protrudes to the side of the thermal fixing unit applying a lower temperature to its side of the paper than the other side of the thermal fixing unit. In this construction, the curling may be appropriately removed even where the curling increases due to the unequal application of heat to the front and back sides of a sheet passing through a thermal fixing unit having a heater only on the image formation side.

The objects are also attained by a sheet decurling apparatus comprising: a first conveyance path that has a means to form a loop in the sheet by making the speed of conveyance of the top edge of the sheet different from the speed of conveyance caused by the conveyance means that is immediately before it; a second conveyance path that does not form a loop in the sheet; conveyance path alternating means that guides the sheet to either of the conveyance paths above; detector that detects the properties of the sheet or the humidity inside the paper cassette; and controller that operates the conveyance path alternating means based on the results of detection by the detector.

In this construction, curling is removed by alternating between the two conveyance paths based on the detected properties of the sheet or the humidity.

The invention itself, together with further objects and attendant advantages, will best be understood by reference to the following detailed description taken in conjunction with the accompanying drawings.

BRIEF DESCRIPTION OF THE DRAWINGS

In the following description, like parts are designated by like reference numbers throughout the several drawing.

DETAILED DESCRIPTION OF THE PREFERRED EMBODIMENTS

Figure 1:
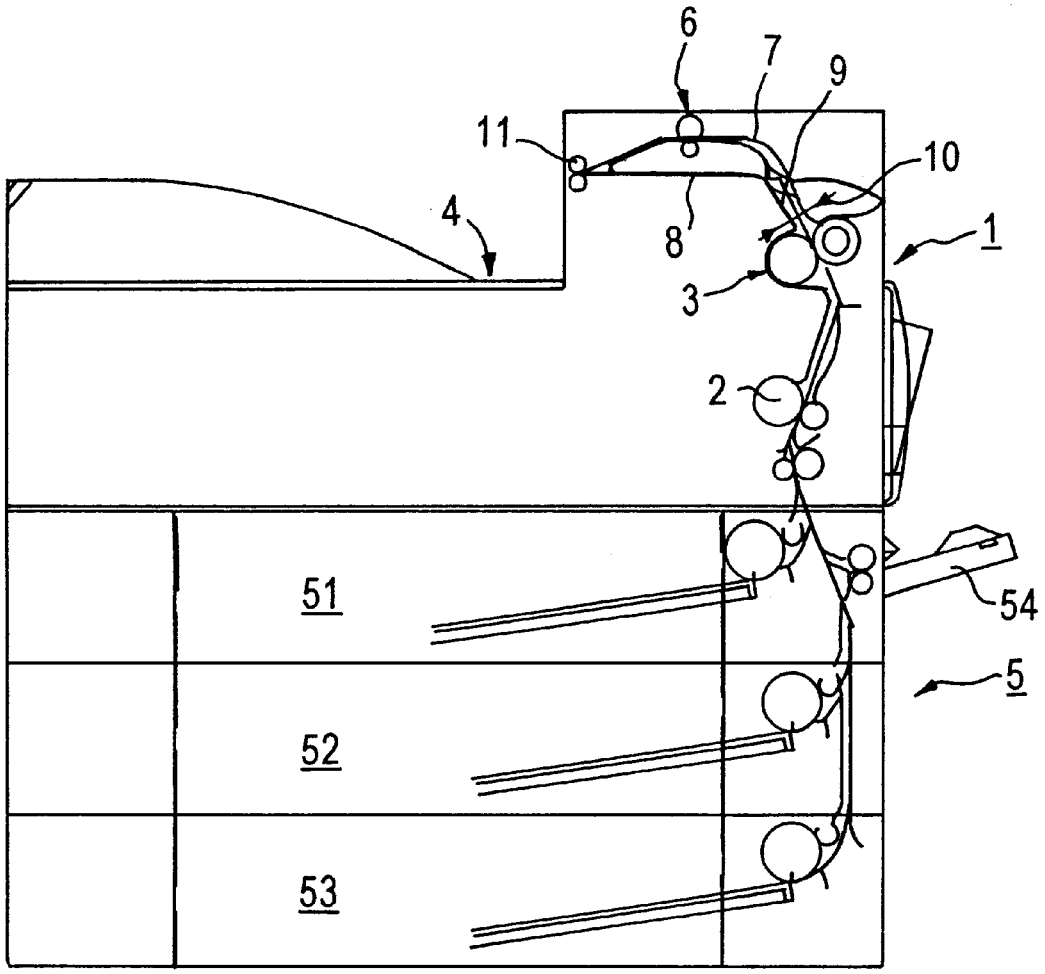
FIG. 1 shows the construction of an image forming apparatus having the sheet decurling apparatus comprising a first embodiment of the invention.
Figure 2:
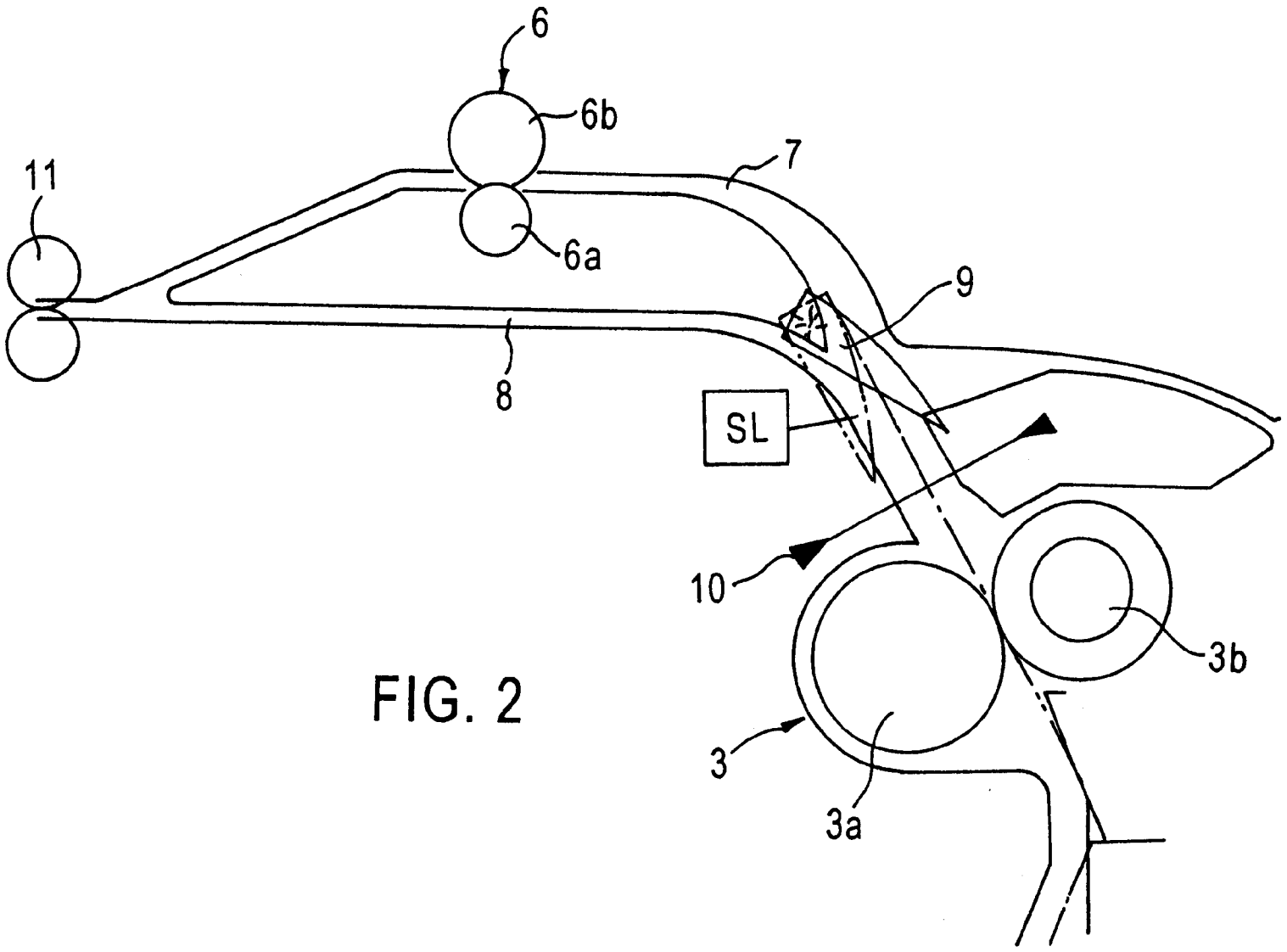
FIG. 2 shows the detailed construction of this sheet decurling apparatus.

The embodiments of the present invention are explained below with reference to the drawings. The sheet decurling apparatus comprising each embodiment is mounted in an electrophotographic image forming apparatus such as a laser bean printer or copying machine. FIG. 1 shows an image forming apparatus pertaining to a first embodiment. FIG. 2 shows the details of the sheet decurling apparatus mounted in this apparatus. The image forming apparatus 1 transfers the toner image formed on the photoreceptor 2 onto a sheet that is conveyed to the transfer area, fixes the transferred image onto the sheet by a thermal fixing device 3, and ejects the sheet on which an image is now formed onto a paper eject tray 4. The various electrophotographic processing units located around the photoreceptor 2 are omitted from the drawings. The sheets are supplied from a paper supply device 5. The paper supply device 5 has multiple sheet supply units, i.e., paper cassettes 51, 52 and 53 and manual paper tray 54. The thermal fixing device 3 comprises a heat roller 3*a* and a pressure roller 3*b*.

Figure 3:
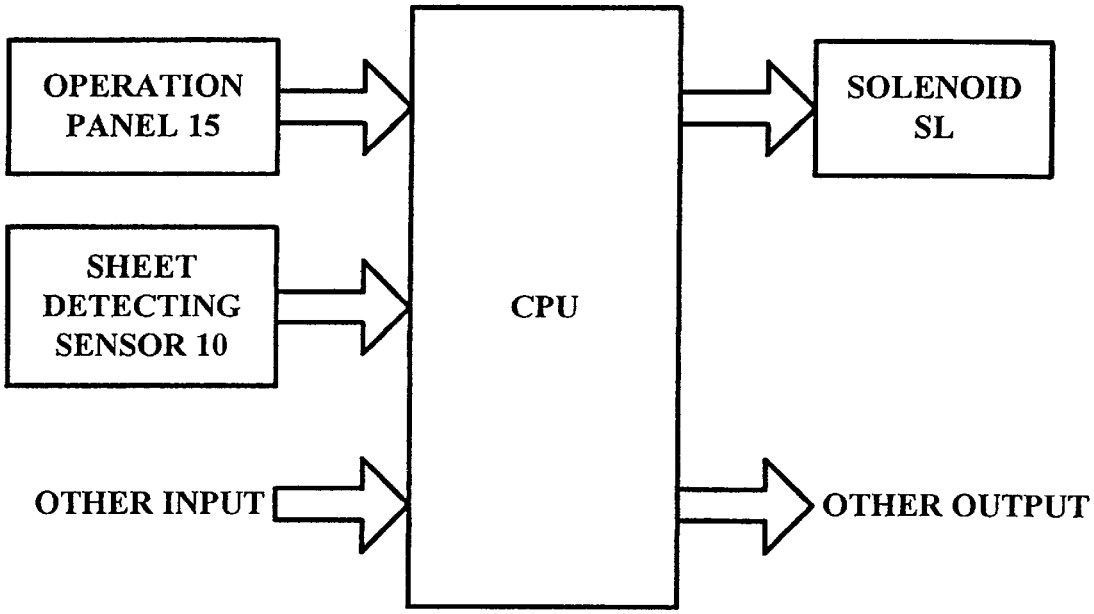
FIG. 3 shows an embodiment of the control circuit of the present invention.

The conveyance path for the sheet forks into two paths downstream from the thermal fixing device 3 along the direction of conveyance. One conveyance path comprises a decurling path 7 having a decurling mechanism 6 and the other is a path 8 that does not have any such mechanism. The decurling mechanism 6 of this embodiment comprises a pair of rollers, i.e., a hard roller 6a and a soft roller 6*b,* such that a bending force is inflicted on the sheet through the warping area comprising the nipping area between the hard roller and the soft roller. In the decurling mechanism 6, the hard roller 6*b* is located such that it will face the side of the sheet that is heated by the heat roller 3*a* of the fixing device 3. The hard roller 6*a* presses onto the soft roller 6*b,* or presses the sheet toward its back side, so that the curling may be removed. Further, an alternating claw 9 that alternates the paths by turning ON or OFF a solenoid SL is located immediately before the bifurcation of the conveyance path. It is specified in advance for each sheet supply unit of the paper supply device 5 whether or not the sheets from the unit are to be subjected to decurling, and based on this instruction, the alternating claw 9 is operated through the control of the solenoid SL by the CPU shown in FIG. 3, so that the sheet is guided to the prescribed path. A sheet detecting sensor 10 is located before the alternating claw 9, and when the top edge detection signal from this sensor is received, the alternating claw 9 is operated to select the specified path. Both conveyance paths join at the lower ends, and paper eject rollers 11 are located beyond the point at which the conveyance paths join together.

In this construction, sheets of a prescribed type are placed in each sheet supply unit, and it is specified in advance, based on the properties of the sheets in each sheet supply unit, whether the decurling operation should be performed, such that control may be performed based on this specification. In other words, during image output by the image forming apparatus 1, the controller operates the alternating claw 9 based on the specification described above in accordance with the sheet supply unit from which the sheet has been supplied and changes the path through which the image-carrying sheet passes. The sheet supply unit from which the sheet should be supplied is determined in accordance with an instruction by the operator to the image forming apparatus 1 regarding the image output or the type of the image formation. A toner image is transferred from the photoreceptor 2 onto the sheet using the electrophotographic method, and the image is fixed to the sheet by the fixing device 3. Based on the properties or type of the sheet, curling may or may not be caused by the thermal fixing process. With some types of paper, a reverse effect may result from decurling.

Therefore, the sheets from sheet supply units that require decurling are guided to the decurling path 7 having a decurling mechanism 6, and the sheets from sheet supply units that do not require decurling are guided to the path 8 having no such mechanism. The decurling mechanism 6 decurls by warping the sheet in the direction opposite the direction of curling caused by the thermal fixing process. In the thermal fixing device 3 having the construction described above, more heat is applied to the front side (image side) of the sheet that comes into contact with the heat roller 3*a,* and therefore, when curling occurs, the sheet curls up such that it is convex on the front side. Using the decurling mechanism 6 having the construction described above, such curling may be appropriately removed.

Specifically, by equipping the image forming apparatus with a means (the paper properties input means described below and shown in FIGS. 9 through 14) by which the operator or service technician may specify for each sheet supply unit whether the sheets from the unit should be subjected to decurling, decurling takes place only when a sheet supply unit having plain paper is selected. In the case of a sheet supply unit containing special types of paper for which decurling is not specified, such as thick paper or transparencies, decurling does not take place. In most cases, however, paper supplied from a paper cassette is plain paper, and it is appropriate to select decurling. Therefore, automatic decurling should be specified for paper cassettes. Where paper is supplied from the manual paper tray, the paper might be a special type, and therefore it is safer not to decurl. Therefore, no automatic decurling should be specified. Further, by equipping the image forming apparatus with a means by which the operator or service technician may set the degree of the decurling effect for each sheet supply unit, the appropriate decurling effect may be obtained.

Figure 4:
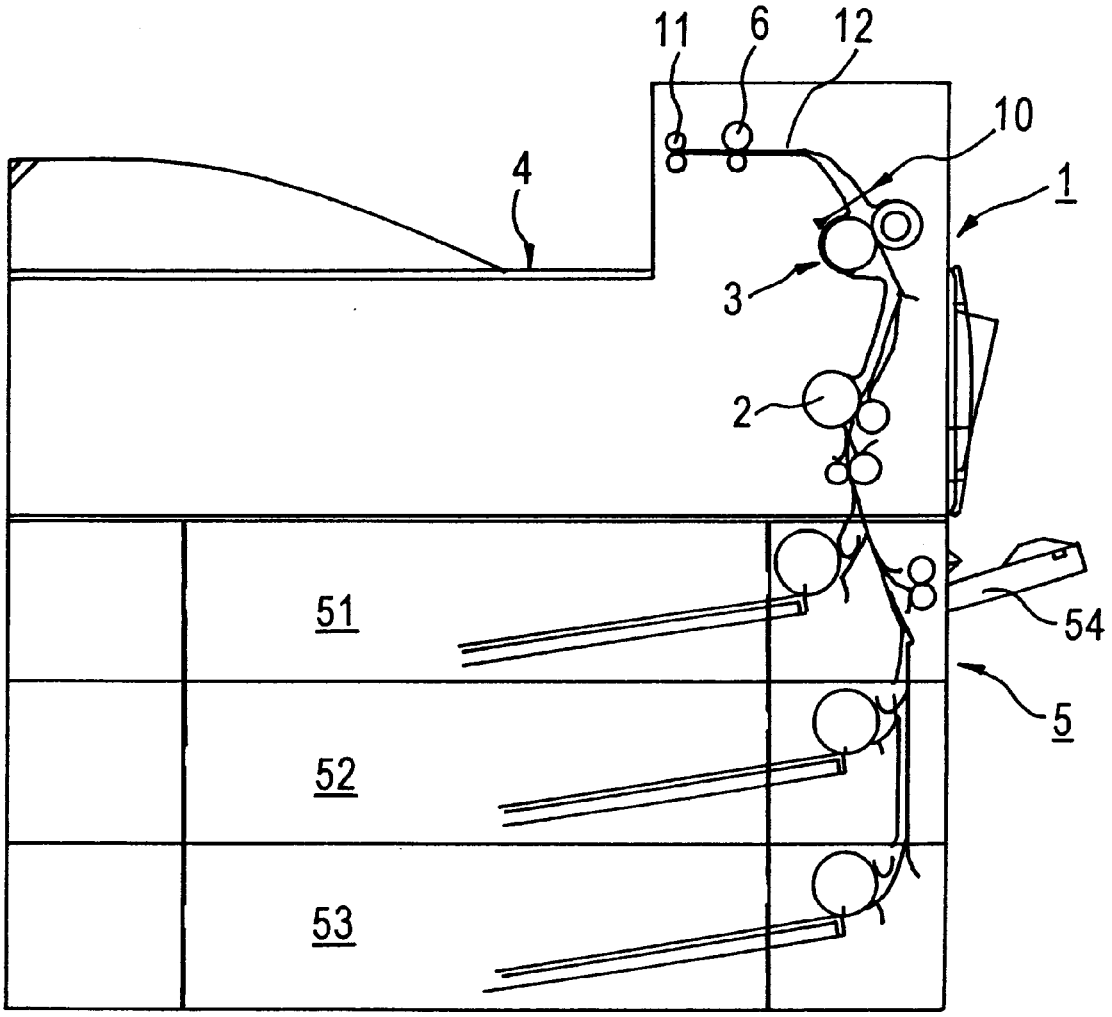
FIG. 4 shows the construction of an image forming apparatus having the sheet decurling apparatus comprising a second embodiment of the invention.
Figure 5:
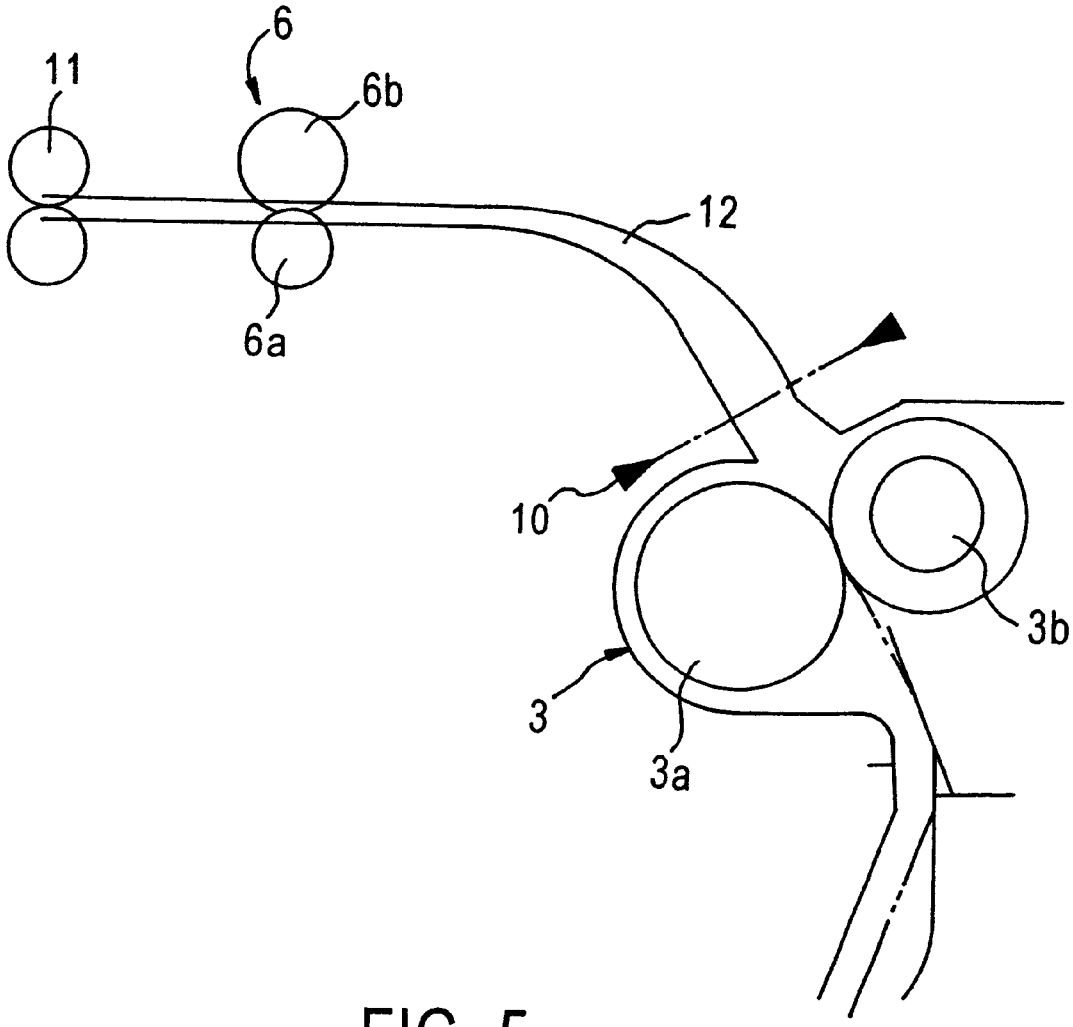
FIG. 5 shows a detailed construction of this sheet decurling apparatus.

FIG. 4 shows an image forming apparatus pertaining to a second embodiment. FIG. 5 shows the details of the sheet decurling apparatus mounted in this apparatus. In this embodiment, a decurling mechanism 6 having a variable degree of decurling effect is located in a single conveyance path 12, which does not branch into two paths downstream from the fixing device 3. The degree of decurling effect is controlled by the CPU based on the advance setting for each sheet supply unit. The mechanism to change the degree of decurling effect involves changing the pressure exerted by the nipping rollers, i.e., a hard roller 6*a* and a soft roller 6*b,* by a solenoid SL. A cam may be used in place of a solenoid SL.

Figure 6:
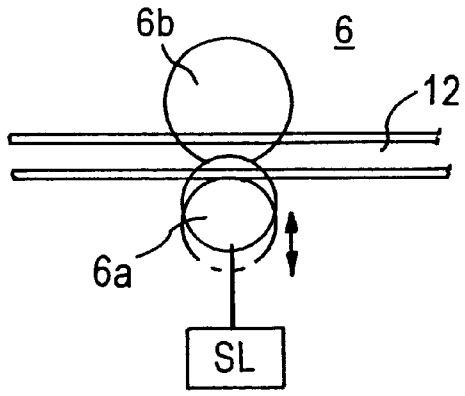
FIG. 6 shows an example of the construction of the decurling mechanism.
Figure 7:
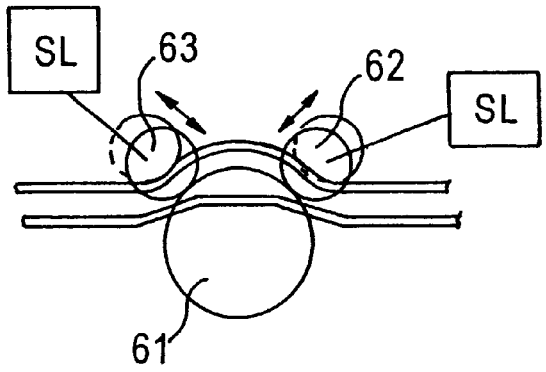
FIG. 7 shows another example of the construction of the decurling mechanism.
Figure 8:
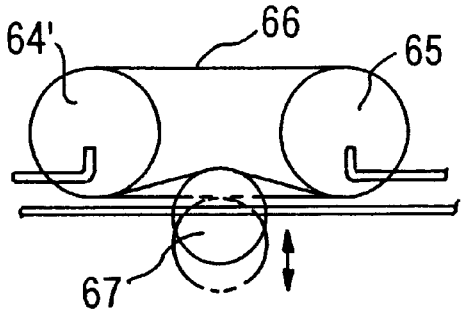
FIG. 8 shows yet another example of the construction of the decurling mechanism.

The decurling mechanism 6 in each embodiment described above may take various forms, which are shown in FIGS. 6 through 8. FIG. 6 shows the construction used in the second embodiment, and the roller 6*a* can move relative to the roller 6*b*. FIG. 7 shows an example in which multiple small-diameter rollers 62 and 63 press onto the circumference of a large-diameter roller 61, so that the sheet may warp to match the radius of curvature of the large-diameter roller 61. FIG. 8 shows an example in which the sheet is warped using a roller 67 that presses onto a conveyance belt 66 suspended over two rollers 64 and 65. In any of these examples, the degree of decurling effect may be varied by changing the pressure of the roller or rollers by a solenoid SL.

Figure 9:
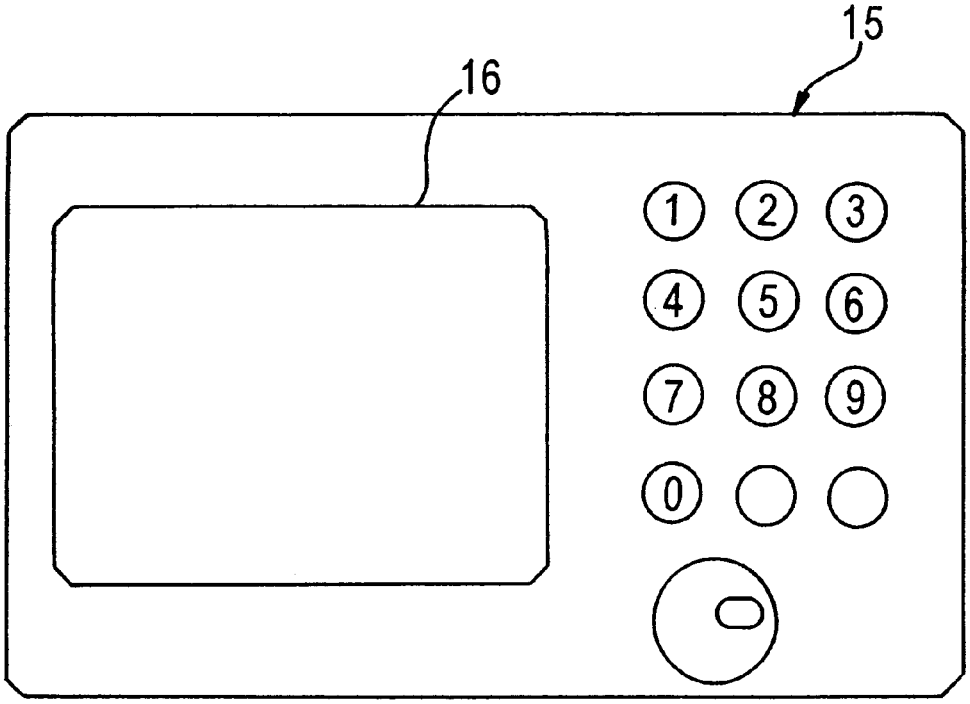
FIG. 9 shows the paper properties input means.
Figure 10:
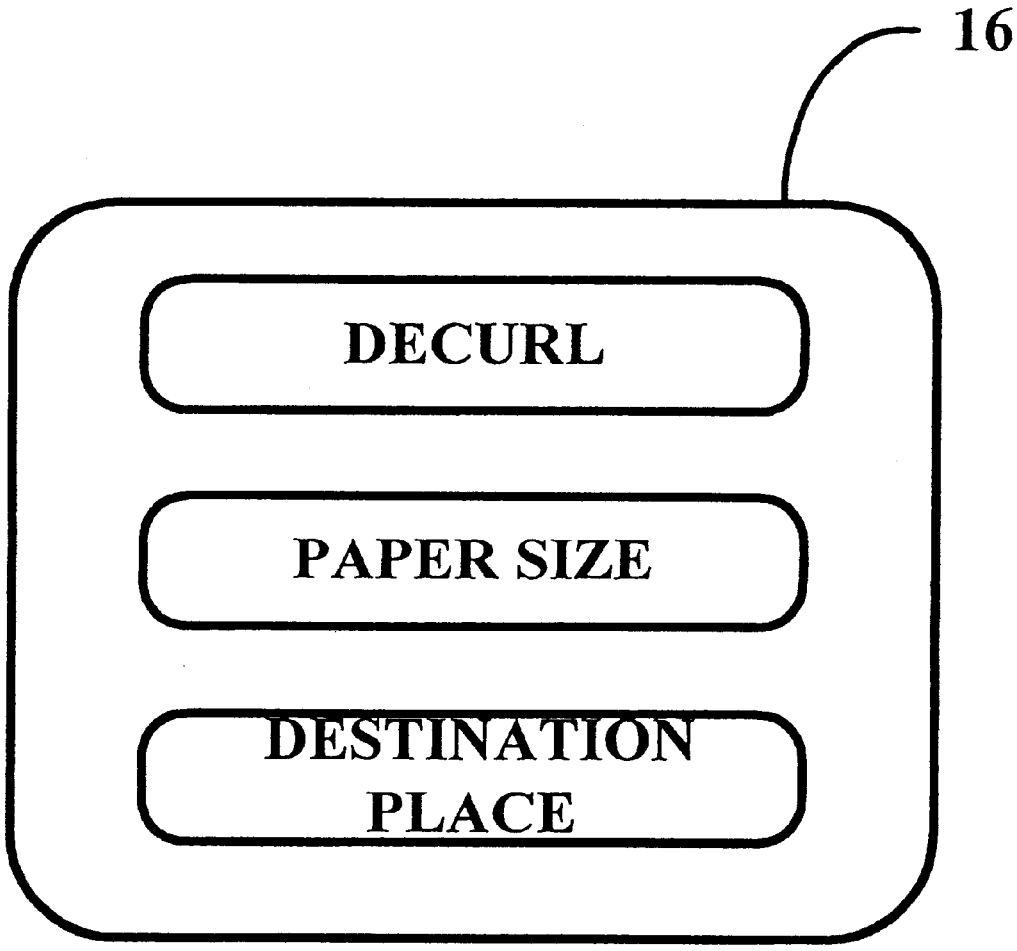
FIG. 10 shows an example of the display in the input means.
Figure 11:
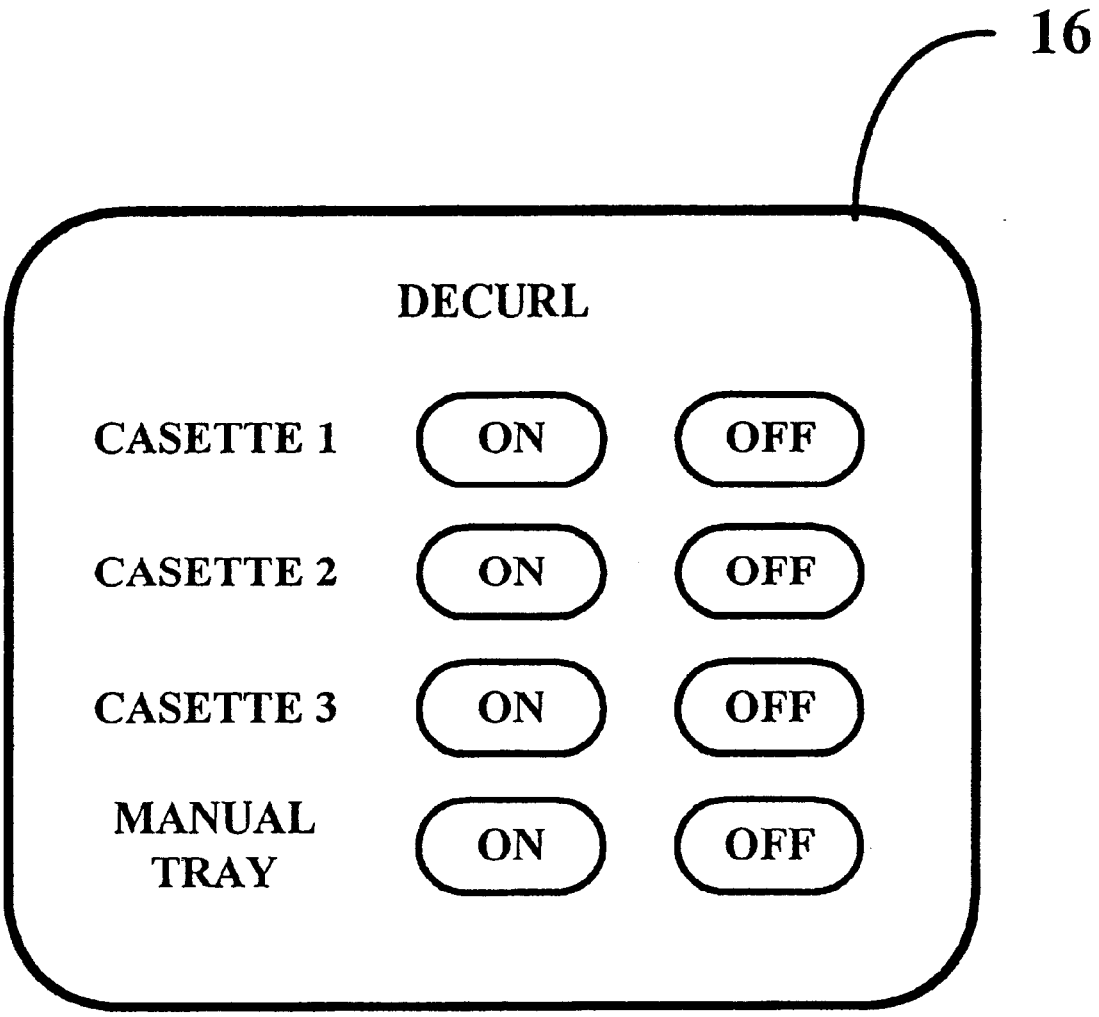
FIG. 11 shows an example of the display in the input means.
Figure 12:
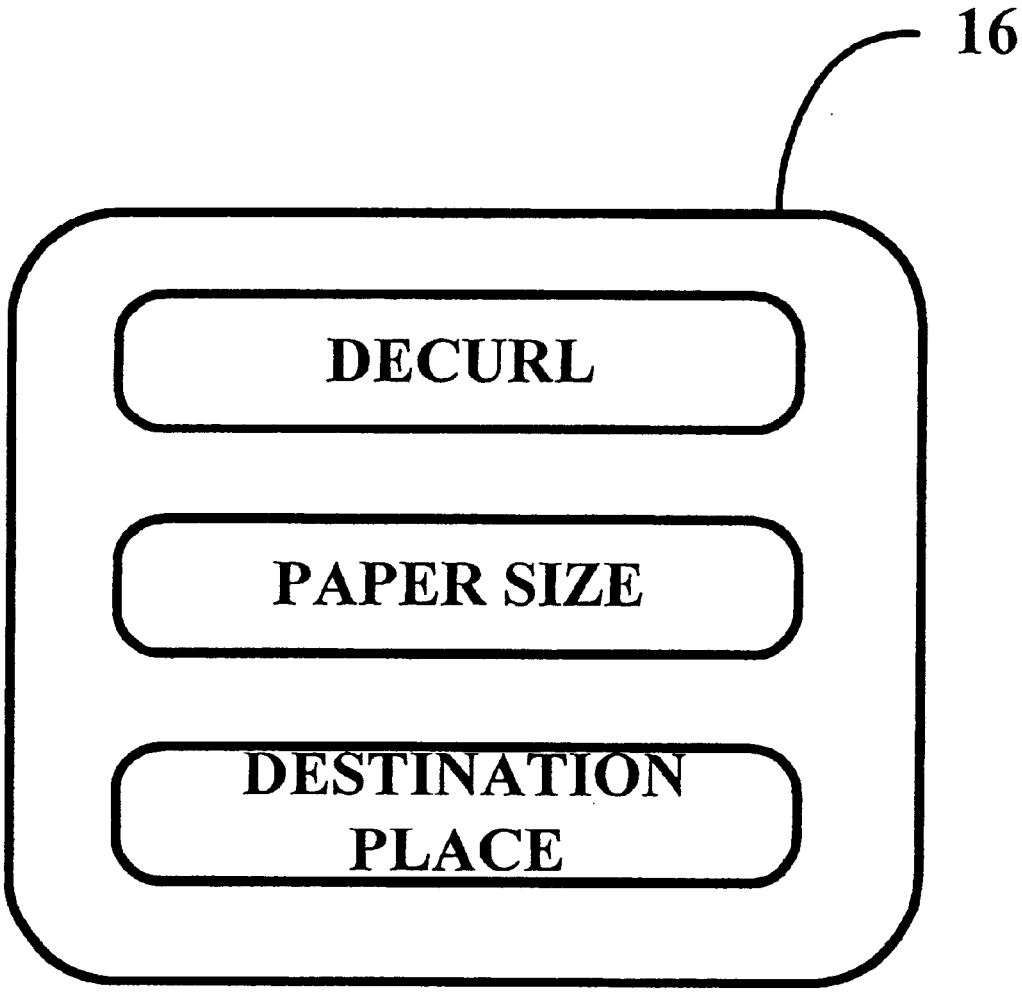
FIG. 12 shows another example of the display in another input means.
Figure 13:
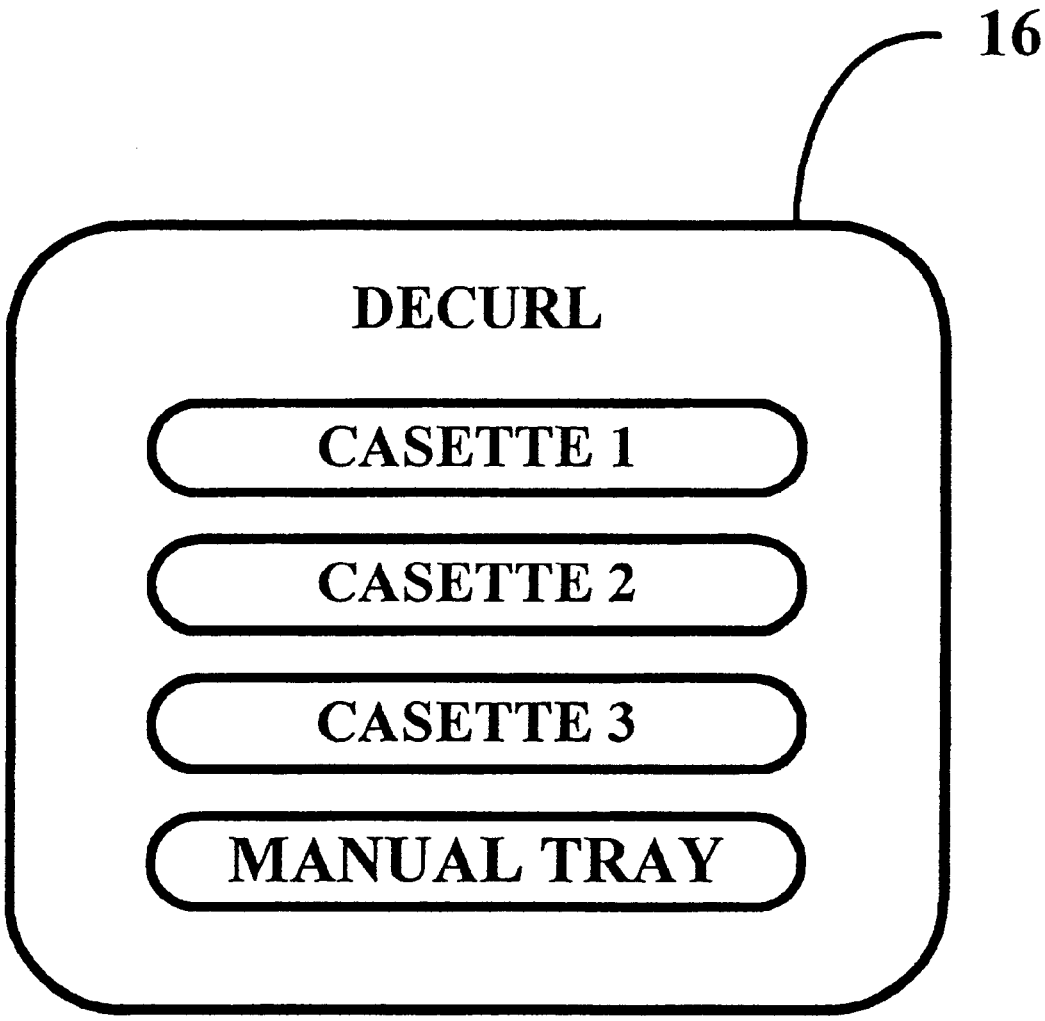
FIG. 13 shows an example of the display in the same input means.
Figure 14:
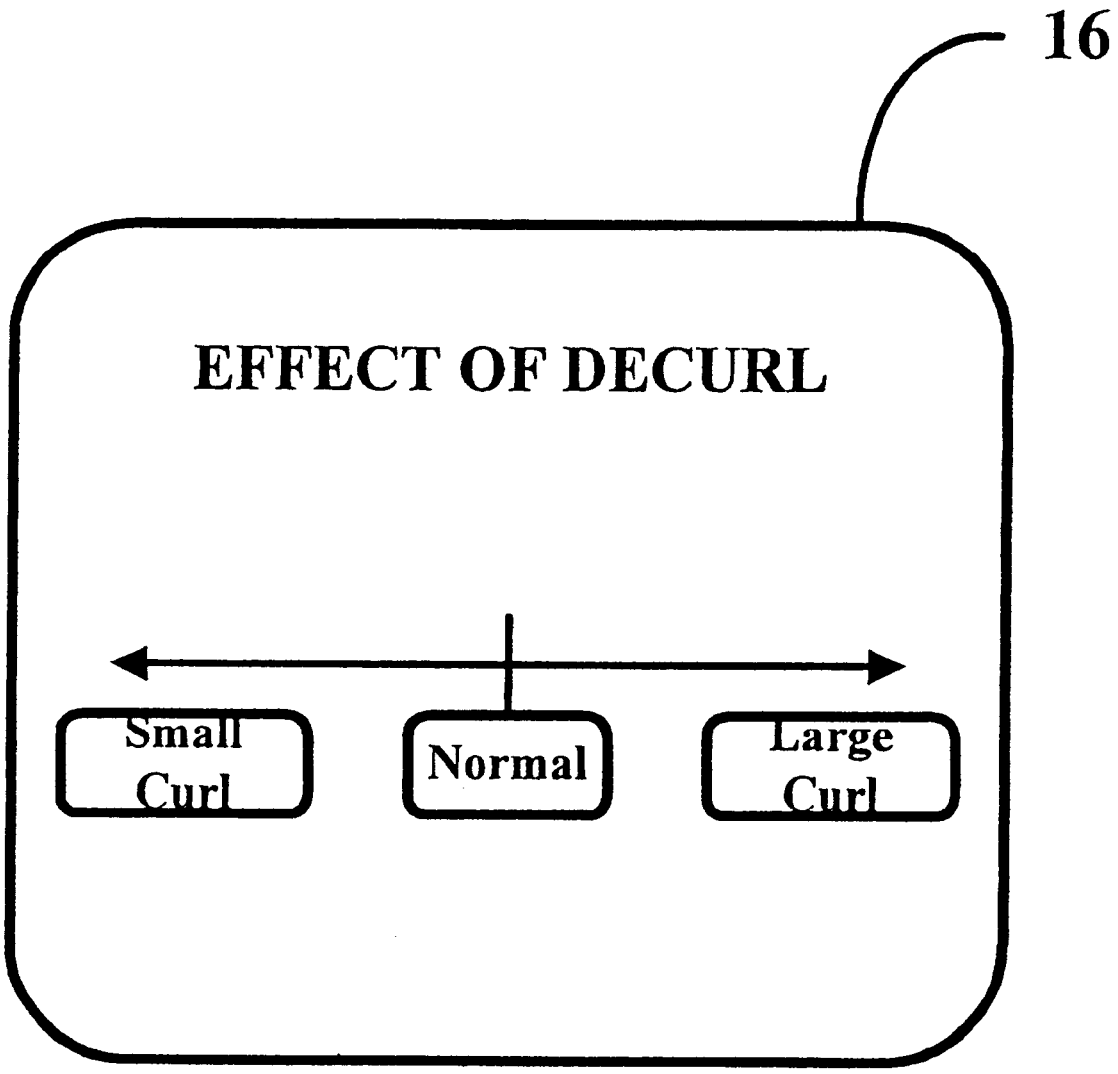
FIG. 14 shows an example of the display in the same input means.

FIG. 9 shows an operation panel 15, which comprises the paper properties input means mounted in the image forming apparatus 1. The operation panel 15 has touch keys and a touch panel 16, using which the operator or service technician may specify whether or not a decurling effect should be applied to the sheets from each sheet supply unit. FIGS. 10 and 11 show examples of the display on the LCD 16. In the display shown in FIG. 10, if 'Set decurling' is selected, the display shown in FIG. 11 appears and it may be specified for each paper cassette and the manual paper tray whether or not decurling should be performed. FIGS. 12 through 14 show other display examples. Using the display shown in FIG. 14, the degree of decurling may be specified.

Figure 15:
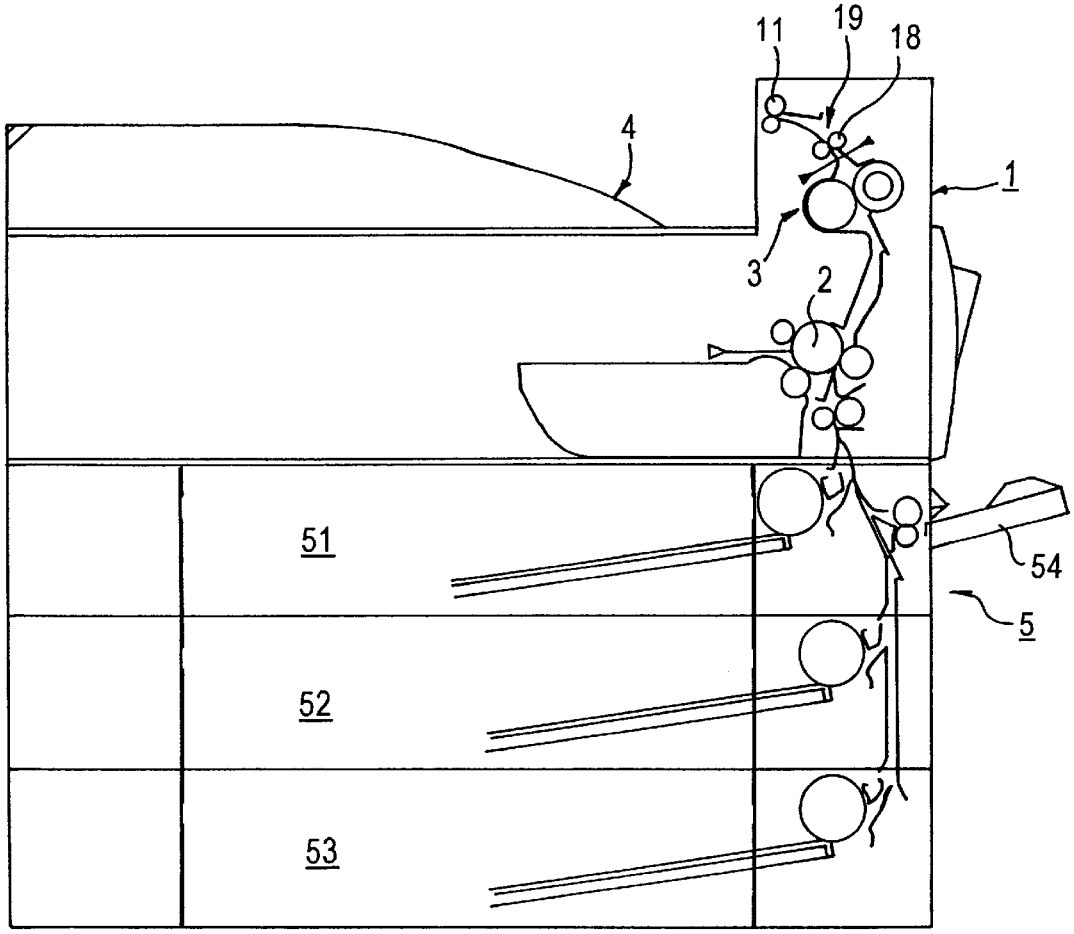
FIG. 15 shows the construction of an image forming apparatus having the sheet decurling apparatus comprising a third embodiment of the present invention.
Figure 16:
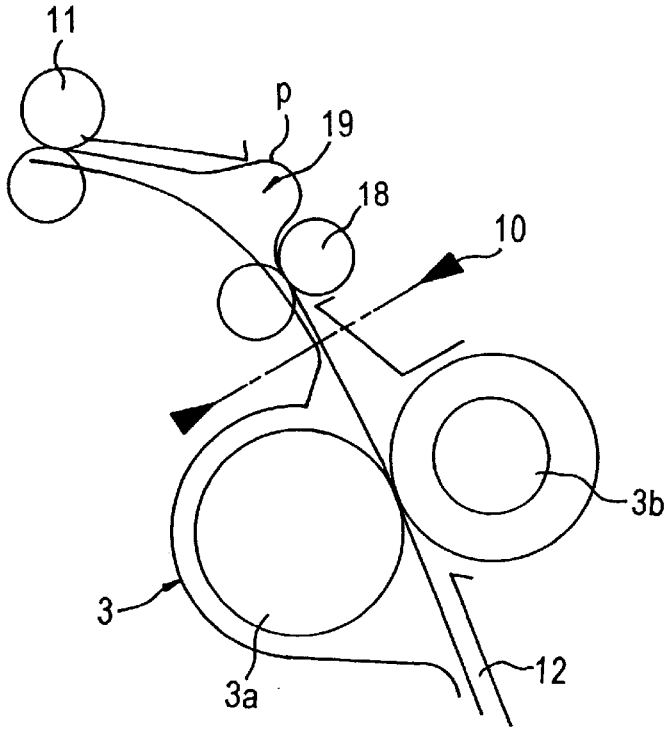
FIG. 16 shows the detailed construction of this sheet decurling apparatus.

FIG. 15 shows an image forming apparatus pertaining to a third embodiment, and FIG. 16 shows the details of the sheet decurling apparatus mounted in this apparatus. The same numbers are used for the same members as in the previous embodiments. Unlike the previous embodiments, this embodiment has a means to create a loop in the sheet by creating a difference in speed along the conveyance direction of the sheet subjected to thermal fixing, as well as a cavity to receive the loop. Decurling is performed by this mechanism. The loop creating means comprises a conveyance roller 18 that conveys the sheet (the first conveyance means) and a paper eject roller 11 that is located downstream from the conveyance roller 18 (the second conveyance means). By making the conveyance speed for the top edge of the sheet slower for the paper eject roller 11, a loop used for decurling is created in the sheet P, and the loop is received in the cavity 19, as shown in FIG. 16.

The cavity 19 to receive the loop protrudes on the side of the sheet as to which the temperature of the thermal fixing device 3 is set to be lower. When the sheet passes through the fixing device, which has a heater only on the side of the sheet on which an image is formed, the front and back sides of the sheets are subjected to different amounts of heat, and therefore, the sheet curls up. Using the construction described above, however, the curl may be appropriately removed.

Figure 17:
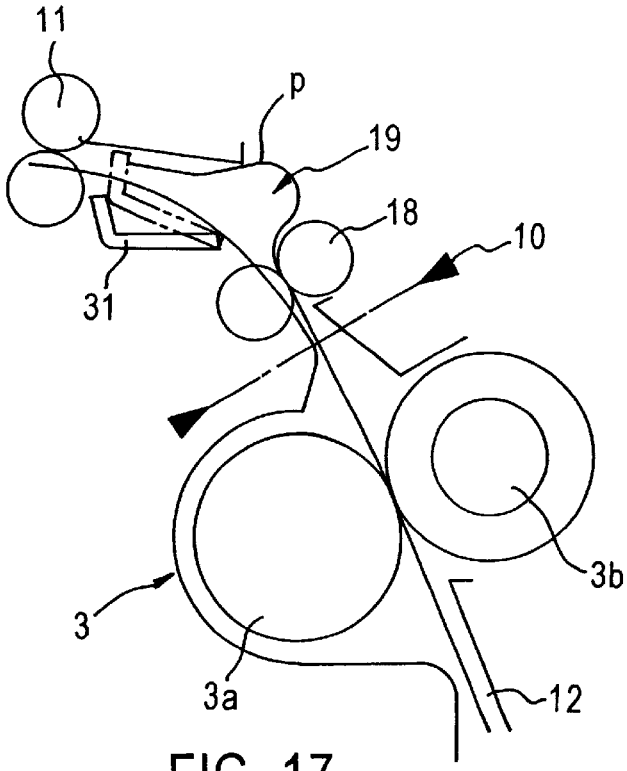
FIG. 17 shows the detailed construction of a modified version of the sheet decurling apparatus.

FIG. 17 shows a modified version of the sheet decurling apparatus of the embodiment described above. The loop creating means shown in this drawing comprises a stopper 31 that enters and retracts from the path between the conveyance rollers 18 and the paper eject rollers 11, and that stops the top edge of the sheet for a prescribed period of time. By controlling this period of time in which the conveyance of the sheet is put on hold, the degree of decurling effect may be adjusted.

Figure 18:
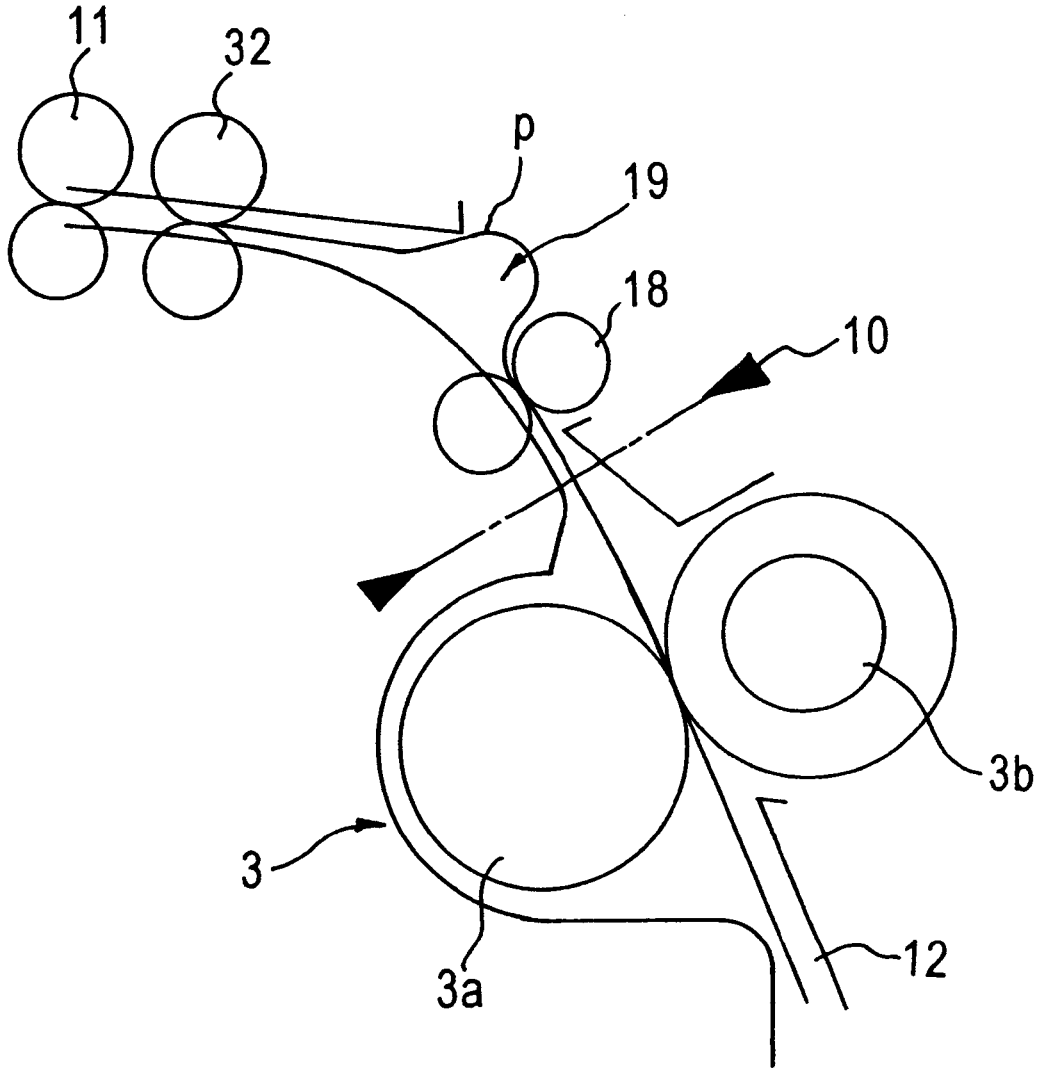
FIG. 18 shows the detailed construction of a modified version of the sheet decurling apparatus.

FIG. 18 shows another modified version of the sheet decurling apparatus of the previous embodiment. The loop creating means shown in this drawing comprises a pair of non-driven rollers 32 located between the conveyance rollers 18 and the paper eject rollers 11. When the top edge of the sheet comes into contact with the pair of rollers 32, the pair of rollers create a load and the top edge is temporarily held in place, resulting in curling in the sheet P, which produces the desired decurling effect. By changing this load, the degree of decurling effect may be adjusted.

The decurling method used in the third embodiment and in its modified versions is a method in which the sheet is warped in the direction opposite the direction of curling caused by the fixing process in order to create a loop in the sheet, and as described above, the degree of decurling effect may be varied by changing the curve of the loop. The degree of decurling effect, i.e., the degree of curvature of the loop, is controlled based on the detection results from various means that detect the paper properties (type and parameters of the sheet, size, thickness, moisture content or humidity inside the paper cassette, etc.)

The properties detecting means may comprise various means that the operator selects from the operation panel during print mode setting. Specific means are shown below.

The detector to detect the paper thickness may be achieved by specifying the paper thickness for each cassette in advance so that the applicable thickness may be specified when the operator selects a sheet supply unit during print mode setting. The thicker the paper is, the less curling occurs due to thermal fixing. Therefore, control should be performed such that the degree of curvature of the loop becomes smaller or is eliminated entirely as the paper thickness increases.

The detector to detect the paper type may comprise an optical sensor such as a transmission sensor or reflection sensor. By using an optical sensor, the detection of transparencies is made easy. The means may be that the paper type is specified for each cassette in advance, or that the operator specifies the paper type from the operation panel during print mode setting. Transparencies are made of PET resin, which softens when the thermal fixing heat is applied and hardens when cooled. Therefore, if a loop is formed in the transparency after the thermal fixing process, it is likely that it will harden while curved in the direction of the loop. Therefore, the amount of the loop should be made small or no decurling should be performed when it is detected that the paper type is a transparency. Where it is detected that the paper type is a semi-transparent secondary original, the amount of the loop should be made large to compensate for a large degree of curling.

The means to detect the paper size may comprise manual or automatic paper size specification for each paper cassette. When using a thermal fixing device having a heater only on the side of the sheet on which an image is formed, while the pressure roller, which does not have a heater, accumulates some heat from the heat transmitted from the heat roller, when large sheets are supplied continuously, the heat is absorbed from the pressure roller by the sheets, increasing the difference in heat between the front side and the back side of the sheet. Consequently, the curling in the sheet also tends to be large. Therefore, by increasing the degree of curvature of the loop for large size paper, the appropriate decurling effect may be obtained.

The means to detect the moisture content of the sheet may comprise a method in which the electrical resistance between the front and back sides of the sheet or between two points on one side of the sheet is measured, a method in which an electric charge is impressed onto the sheet and the remaining charge is detected after a prescribed period of time, a method in which the rate of transmission of microwaves through the sheet is measured, or a method in which the moisture content of the paper inside the cassette is estimated based on the detected humidity inside the paper cassette and the time that has elapsed since the paper cassette was opened. Generally, the curling caused by the thermal fixing process increases as the moisture content of the paper increases. In particular, where a thermal fixing device having a heater only on the image formation side is used, because the front and back sides of the sheet are subjected to different amounts of heat, the curling tends to be large. In addition, the direction of curling of some types of paper changes when the moisture content drops to around 5%, although this is also affected by the heat amount from the thermal fixing device. Therefore, control may be performed such that (i) the amount of the loop increases as the moisture content increases, and (ii) the direction of the loop changes when a certain threshold level is reached. A humidity sensor may be used to detect the humidity inside the paper cassette. The higher the humidity, the higher the moisture content of the sheets inside the cassette and the larger the degree of curling becomes. Therefore, control should be performed such that the curvature of the loop increases as the humidity increases.

The amount of curling also tends to increase as the number of sheets supplied into the apparatus increases, because the heat radiated by the roller that does not have a heater decreases as more sheets are supplied, in the same manner as for large size paper described above. Therefore, using counter to count the number of sheets supplied into the apparatus, the curvature of the loop should be adjusted to increase as the number of supplied sheets increases.

Figure 19:
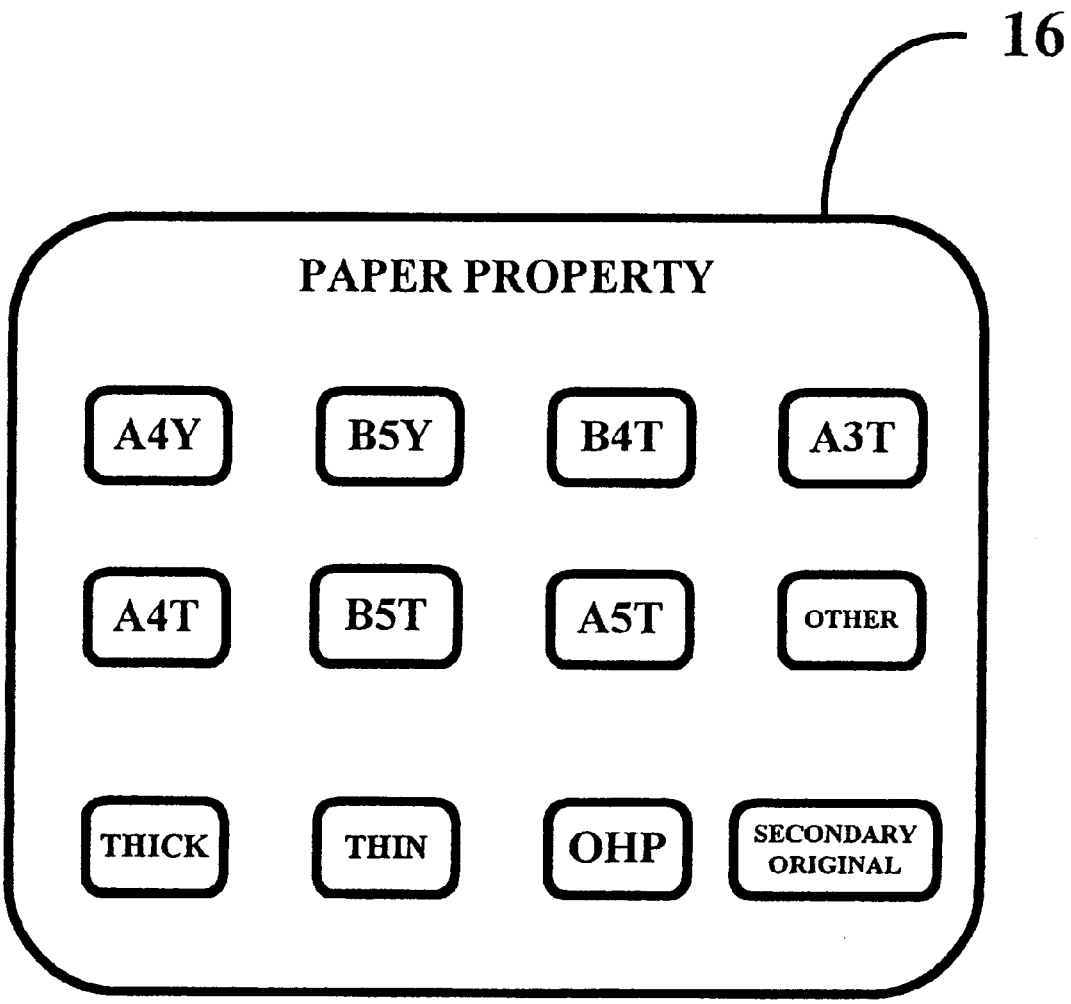
FIG. 19 shows the paper properties input means.

FIG. 19 shows an example of the display in the touch panel 16 comprising a paper properties input means. In this example, paper size and paper type are specified for each paper cassette, but whether or not decurling should be performed is programmed in advance in the apparatus in response to the settings made.

Figure 20:
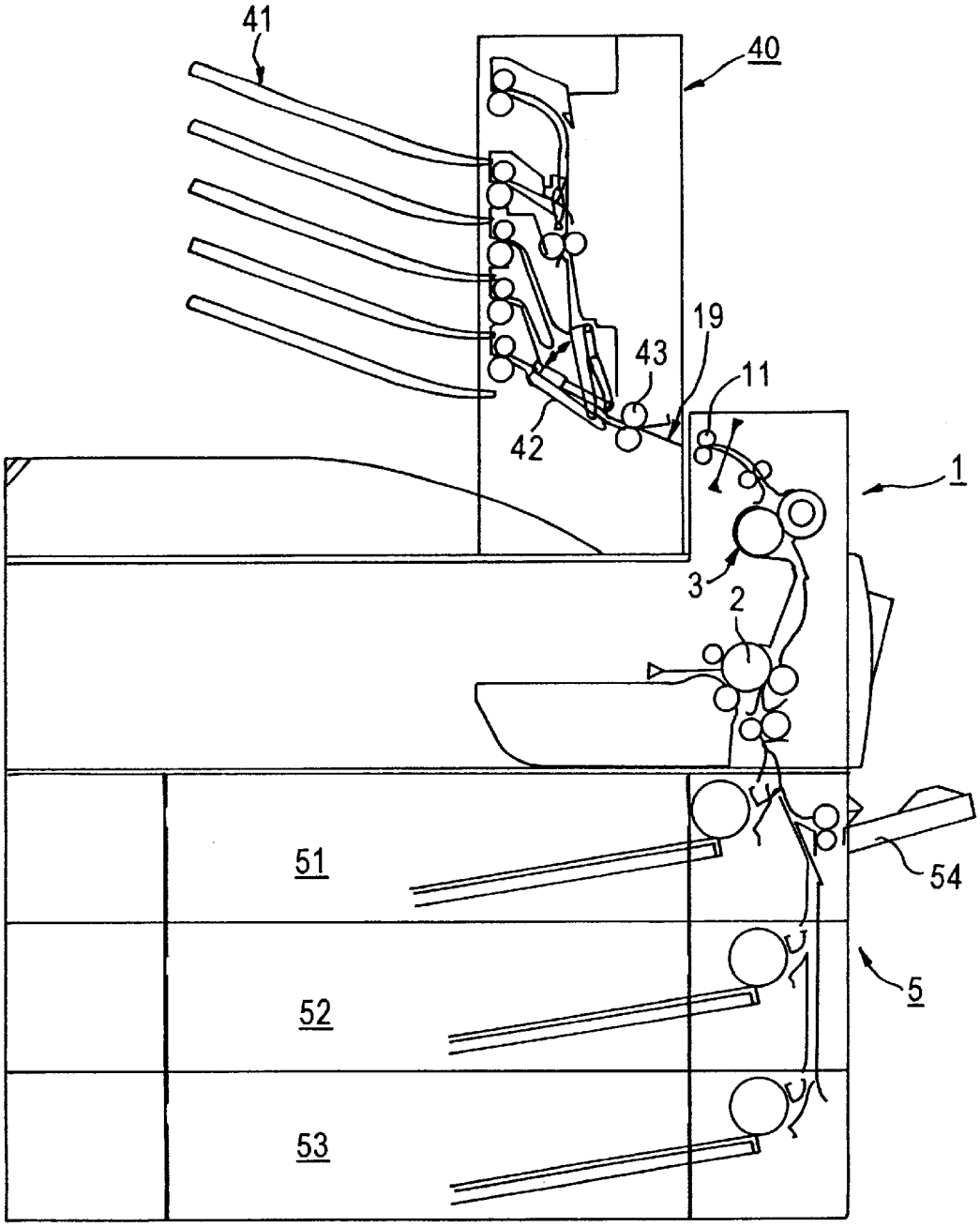
FIG. 20 shows the construction of an image forming apparatus having the sheet decurling apparatus comprising a fourth embodiment of the present invention.

FIG. 20 shows an image forming apparatus pertaining to a fourth embodiment. In this embodiment, a paper eject device 40, such as a sorter that receives the sheets ejected after image output, is attached to the image forming apparatus 1. The paper eject device 40 has multiple bins 41 to receive the sheets, a path alternating mechanism 42 to perform sorting, and receiver rollers 43 (the second conveyance means) that receive the sheets ejected by the paper eject rollers 11 (the first conveyance means) of the image forming apparatus 1. By performing control so that the receiver rollers 43, which are located downstream from the paper eject rollers 11, are driven slower than the conveyance speed of the paper eject rollers 11, the conveyance of the top edge of the sheet may be delayed, creating a loop in the sheet in the cavity 19 formed between the image forming apparatus 1 and the paper eject device 40 (i.e., between the receiver rollers 43 and the paper eject rollers 11). A decurling effect may thus be obtained.

Figure 21:
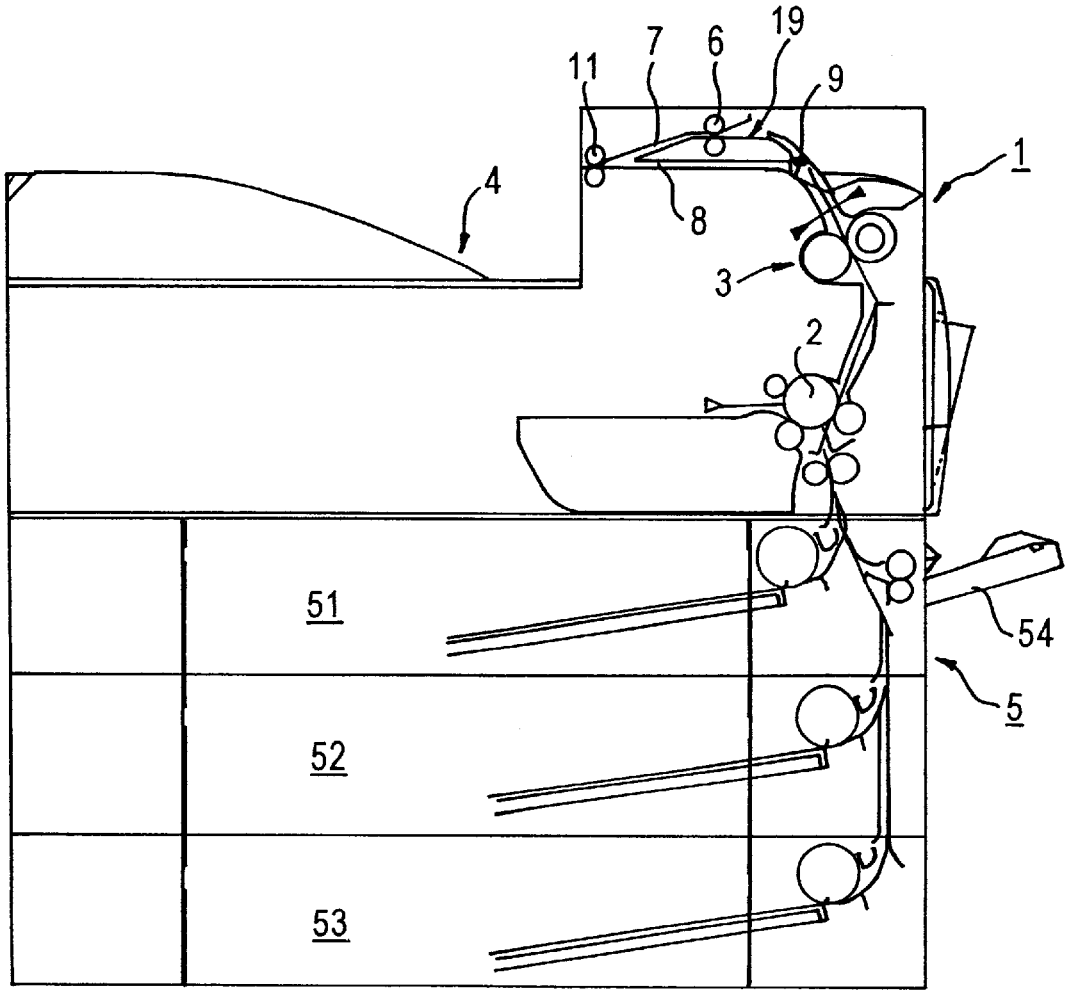
FIG. 21 shows the construction of an image forming apparatus having the sheet decurling apparatus comprising a fifth embodiment of the present invention.
Figure 22:
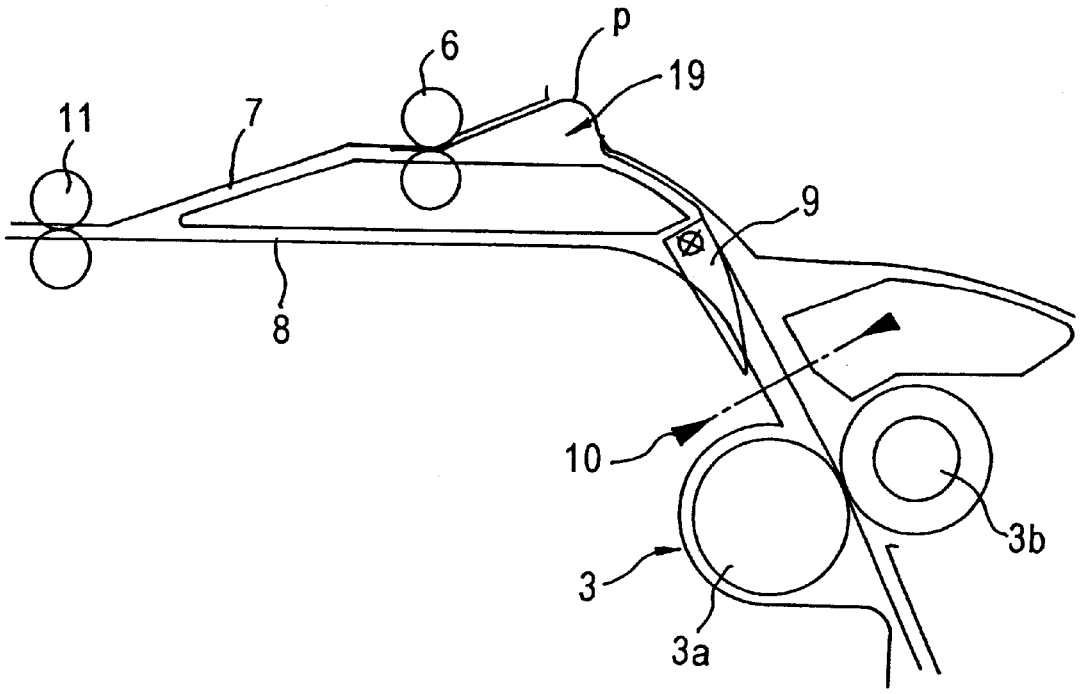
FIG. 22 shows the detailed construction of this sheet decurling apparatus.

FIG. 21 shows an image forming apparatus pertaining to a fifth embodiment, and FIG. 22 shows the details of the sheet decurling apparatus mounted in this apparatus. This embodiment comprises the construction of the first embodiment having a path with a decurling mechanism and a path without a decurling mechanism, combined with the construction of the fourth embodiment to create a loop in the sheet, which works as the decurling mechanism. In other words, this sheet decurling apparatus has a path 7 in which a loop is created in the sheet (the first conveyance path), a cavity 19 to receive the loop, a path 8 in which no loops are created in the sheet (the second conveyance path), and an alternating claw 9 that guides the sheet to one of the two paths, such that the alternating claw 9 alternates between the paths based on the results of the paper properties detection. Using this construction, decurling may also be performed in the same manner as in the previous embodiments.

Figure 23:
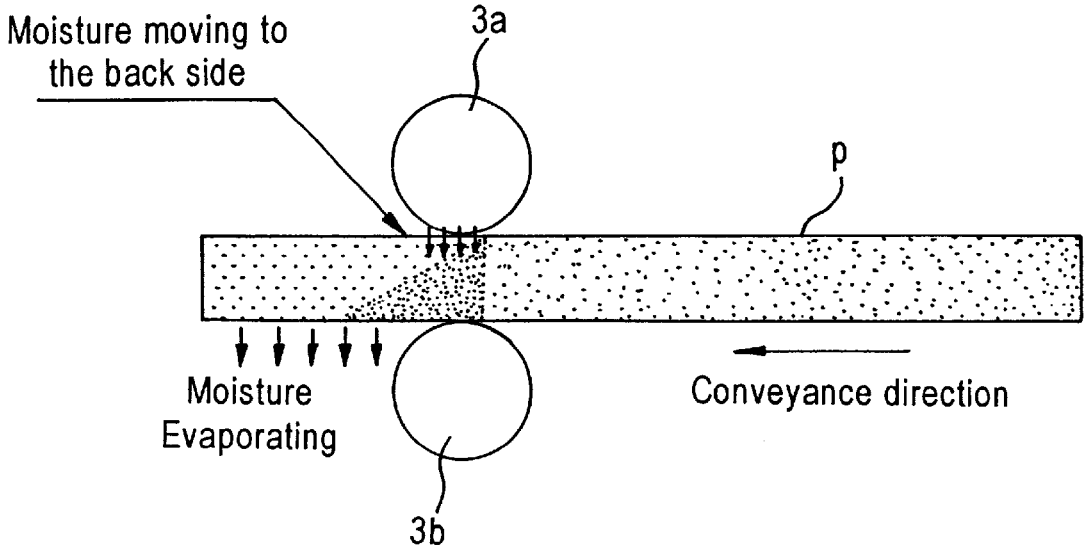
FIG. 23 shows the change when a sheet passes through the thermal fixing unit having a heater on only one side.
Figure 24:
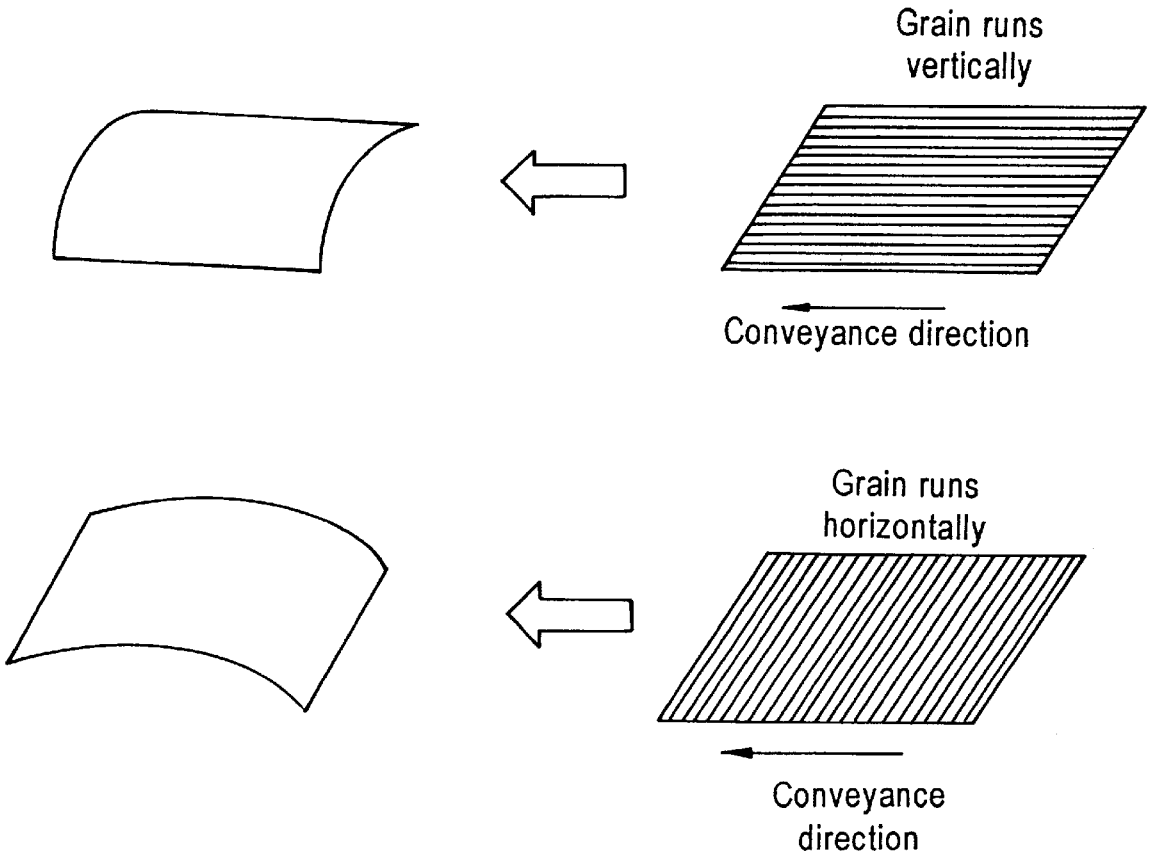
FIG. 24 shows different types of curling based on the direction of the grain of the paper.

FIG. 23 shows the manner in which the sheet P undergoes changes from the application of heat by the thermal fixing device 3 (3*a*, 3*b*) having one heater. The moisture contained in the sheet P moves to the back side of the sheet as the sheet is heated by the heat roller 3*a* that is in contact with the sheet on its front side, and evaporates from the back side. FIG. 24 shows the types of curling that occur, depending on whether the grain of the sheet P runs vertically or horizontally. In either case, curling takes place along the grain of the paper. A decurling effect may be obtained regarding paper in which the grain runs in either direction when the sheet decurling apparatus of each embodiment described above is used.

As explained above, using the sheet decurling apparatus of the present invention, it is determined whether or not decurling should be performed based on the settings for each sheet supply unit, and consequently, decurling may be appropriately performed only on paper that requires decurling (such as plain paper, for example) using a simple construction and without an increase in cost.

In addition, by detecting the paper properties such as various parameters and by performing control such that either (i) a pre-determined degree of curvature is created in the sheet in a pre-determined direction, or (ii) a conveyance path is selected based on the detection results, the same effect as that described above may be obtained.

Although the present invention has been fully described by way of examples with reference to the accompanying drawings, it is to be noted that various changes and modifications will be apparent to those skilled in the art. Therefore, unless such changes and modification depart from the scope of the present invention, they should be construed as being included therein.

What is claimed is:

1. A sheet decurling apparatus, comprising:

a plurality of sheet supply units each capable of supplying one or more sheets:

a first conveyance path having a decurling mechanism within its length and capable of supplying sheets from any sheet supply unit;

a second conveyance path having no decurling mechanism within its length and capable supplying sheets from any sheet supply unit; and selecting means for selecting either said first or second conveyance path depending on the sheet supply unit used to supply the sheets.

2. A sheet decurling apparatus according to claim 1, further comprising:

means for specifying for each sheet supply unit whether the sheets from said each sheet supply unit should be subjected to decurling.

3. A sheet decurling apparatus according to claim 1, wherein said plurality of sheet supply units include a paper cassette and a manual paper tray, sheets supplied from the paper cassette is guided to said first conveyance path, and sheets supplied from the manual paper tray are guided to said second conveyance path.

4. An image forming apparatus, comprising:

a plurality of sheet supply units each capable of supplying one or more sheets;

an image forming device for forming an image on a sheet supplied from one of said plurality of sheet supply units, and thermally fixing the image onto the sheet;

a first conveyance path that has a decurling mechanism within its length and capable of conveying the sheet with the image formed by said image forming device;

a second conveyance path not having a decurling mechanism within its length and capable of conveying the sheet with the image formed by said image forming device; and selecting means for selecting either said first or second conveyance path depending on the sheet supply unit used to supply the sheet to the image forming device.

5. A sheet decurling apparatus according to claim 4, wherein:

said plurality of sheet supply units include a paper cassette and a manual paper tray;

sheets supplied from the paper cassette is guided to said first conveyance path, and sheets supplied from the manual paper tray are guided to said second conveyance path.

6. A sheet decurling apparatus comprising:

a plurality of sheet supply units each capable of supplying one or more sheets;

a conveyance path to convey sheets supplied from the plurality of sheet supply units;

a decurling mechanism located within the length of the conveyance path and capable of removing the curling of a conveyed sheet;

varying means for varying a degree of a decurling effect exerted by the decurling mechanism; and a controller that controls said varying means depending on which of the plurality of sheet supply units supplies the sheets.

7. A sheet decurling apparatus according to claim 6, further comprising:

means for specifying the degree of the decurling effect that is to be exerted by the decurling for mechanism for each sheet supply unit.

8. A sheet decurling apparatus according to claim 6, further comprising:

means for specifying for each sheet supply unit whether the sheet supplied from said each sheet supply unit should be subjected to decurling.

9. An image forming apparatus, comprising:

a plurality of sheet supply units each capable of supplying one or more sheets;

an image forming device that forms an image on a sheet supplied from one of said plurality of sheet supply units, and thermally fixes the image onto the sheet;

a conveyance path to convey the sheet with the image formed by said image forming device;

a decurling mechanism located within the length of the conveyance path and capable of removing the curling of the sheet;

varying means for varying a degree of a decurling effect exerted by said decurling mechanism; and a controller that controls said varying means depending on the sheet supply unit used to supply the sheet to the image forming device.

10. A sheet decurling apparatus, comprising:

first conveyance means for conveying sheets;

second conveyance means located downstream from the first conveyance means;

loop creating means for creating a loop in a sheet being conveyed by making a conveyance speed of a top edge of the sheet conveyed by said second conveyance means different from conveyance speed by which it is conveyed by said first conveyance means so as to removing the curling of a conveyed sheet;

detecting means for detecting the properties of the sheet; and controller that controls the creation of a loop by said loop creating means based on the results of detection by said detecting means so as to adjust the decree of decurling effect of said loop creating means.

11. A sheet decurling apparatus according to claim 10, further comprising:

a counter that counts the number of sheets that are continuously conveyed in one print session, wherein said controller controls said loop creating means based on the output from said counter.

12. A sheet decurling apparatus according to claim 10, wherein said loop creating means controls a conveying speed of at least one of said first conveyance means and said second conveyance means so that the conveying speed of said second conveyance means is slower than the conveying speed of said first conveyance means.

13. A sheet decurling apparatus according to claim 10, wherein said loop creating means stops the top edge of the sheet being conveyed for a prescribed period of time between said first conveyance means and said second conveyance means.

14. A sheet decurling apparatus, comprising:

a plurality of sheet supply units each capable of supplying one or more sheets;

an image forming device for forming an image on a sheet supplied from one of said plurality of sheet supply units, and thermally fixing the image onto the sheet;

first conveyance means for conveying the sheet with the image formed by said image forming device;

second conveyance means located downstream from the first conveyance means;

loop creating means for creating a loop in a sheet being conveyed by making a conveyance speed of a top edge of the sheet conveyed by said second conveyance means different from the conveyance speed by which it is conveyed by said first conveyance means;

detecting means for detecting properties of the sheet; and a controller that controls the creation of a loop by said loop creating means based on results of detection by said detecting means.

15. A sheet decurling apparatus according to claim 14, further comprising:

a cavity that receives the loop in the sheet protrudes to the side of a thermal fixing unit applying a lower temperature to one side of the sheet than the other side of the sheet.

16. A sheet decurling apparatus, comprising:

a first conveyance path that has a means for forming a loop in a sheet by making a speed of conveyance of a top edge of the sheet different from the speed of conveyance caused by an immediately proceeding conveyance means;

a second conveyance path that does not form a loop in the sheet;

conveyance path alternating means that guides the sheet to either of the first and second conveyance paths;

detecting means for detecting properties of the sheet or the humidity inside a sheet cassette; and a controller that operates the conveyance path alternating means based on results of detection by the detecting means.

* * * * *